US010030448B2

(12) United States Patent
Miller

(10) Patent No.: US 10,030,448 B2
(45) Date of Patent: Jul. 24, 2018

(54) LADDER STABILIZATION APPARATUS WITH ADJUSTABLE BRACING MEMBERS FOR USE ON INSIDE AND OUTSIDE CORNERS OF A STRUCTURE

(71) Applicant: Terry James Miller, Calgary (CA)

(72) Inventor: Terry James Miller, Calgary (CA)

( * ) Notice: Subject to any disclaimer, the term of this patent is extended or adjusted under 35 U.S.C. 154(b) by 0 days.

(21) Appl. No.: 15/361,199

(22) Filed: Nov. 25, 2016

(65) Prior Publication Data

US 2017/0152710 A1 Jun. 1, 2017

Related U.S. Application Data

(60) Provisional application No. 62/260,282, filed on Nov. 26, 2015.

(51) Int. Cl.
*E06C 7/48* (2006.01)

(52) U.S. Cl.
CPC ..... *E06C 7/482* (2013.01)

(58) Field of Classification Search
CPC ..... E06C 1/34; E06C 1/04; E06C 7/48; E06C 7/482; E06C 7/484; E06C 7/188; E06C 7/06; E06C 7/505; E06C 7/165
USPC ..... 182/107, 206, 214
See application file for complete search history.

(56) References Cited

U.S. PATENT DOCUMENTS 1,994,369 A * 3/1935 Risser ..... E06C 7/48 182/107
3,715,012 A 2/1973 Perry
4,593,790 A * 6/1986 Brewer ..... E06C 7/482 182/107
5,121,814 A * 6/1992 Southern ..... E06C 7/48 182/111
5,165,641 A * 11/1992 Southern ..... E06C 7/48 182/214
5,323,875 A 6/1994 Kennett
5,622,238 A 4/1997 Farmer
5,850,894 A * 12/1998 Busenhart ..... E06C 7/48 182/107
6,408,983 B1 * 6/2002 Widurski ..... E06C 7/48 182/107

(Continued)

FOREIGN PATENT DOCUMENTS

CA 2115752 12/1993

*Primary Examiner* — Colleen M Chavchavadze
*Assistant Examiner* — Shiref M Mekhaeil
(74) *Attorney, Agent, or Firm* — Kyle R. Satterthwaite; Ryan W Dupuis; Ade & Company Inc.

(57) ABSTRACT

A ladder stabilization apparatus features a ladder engagement unit, and first and second bracing members attached to the engagement unit at a side thereof that faces outwardly from the ladder and each having a respective contact side for abutting against a structure during. The bracing members are securable to the ladder engagement unit in a first position in which the contact sides diverge away from the ladder, and a second position in which the contact sides converge away from the ladder. Placement of the braces in the first position accommodates diverging walls of an outside corner of the structure, while placement of the braces in the second orientation accommodates converging walls of an inside corner of the structure against the contact sides of the bracing members. A slot between the bracing members in the second position accommodates a wall stud or other dimensional frame unit.

20 Claims, 6 Drawing Sheets

(56) References Cited

U.S. PATENT DOCUMENTS

| | | | | |
|---|---|---|---|---|
| 6,691,825 | B2 * | 2/2004 | Haig | E06C 7/14<br>182/107 |
| 6,698,547 | B1 * | 3/2004 | Uridel | E06C 7/14<br>182/107 |
| 6,962,237 | B2 * | 11/2005 | Underhill | E06C 7/48<br>182/107 |
| 7,137,482 | B2 * | 11/2006 | Underhill | E06C 7/48<br>182/107 |
| 8,251,180 | B1 * | 8/2012 | Paige | E06C 7/48<br>182/107 |
| 8,528,695 | B1 | 9/2013 | Orpia | |
| 2004/0055821 | A1 | 3/2004 | Kruse | |
| 2004/0216955 | A1 * | 11/2004 | Unger | E06C 1/34<br>182/206 |
| 2013/0327907 | A1 * | 12/2013 | Reitz | E06C 7/188<br>248/210 |

* cited by examiner

LADDER STABILIZATION APPARATUS WITH ADJUSTABLE BRACING MEMBERS FOR USE ON INSIDE AND OUTSIDE CORNERS OF A STRUCTURE

CROSS REFERENCE TO RELATED APPLICATIONS

This application claims benefit under 35 U.S.C. 119(e) of Provisional Application Ser. No. 62/260,282, filed Nov. 26, 2015, the entirety of which is incorporated herein by reference.

FIELD OF THE INVENTION

The present invention relates generally to ladder stabilization devices, and more particularly to a device attachable to a ladder and having adjustable bracing members with angled contact sides that are movable into different orientations relative to one another to form suitable arrangements for stabilizing a ladder at both inside and outside corners of a building or other structure.

BACKGROUND

A number of prior devices have been proposed for stabilizing the position of a ladder leaned up against a building or other structure, including those disclosed in U.S. Pat. Nos. 6,698,547, 8,528,695, 5,622,238, 5,165,641, 7,137,482, 3,715,012, 1,994,369, 5,323,875 and 6,408,983; U.S. Patent Application Publications 2004/0055821 and 2013/0327907; and Canadian Patent Application 2115752, some of which include means for enabling stabilization of the ladder at both inside and outside corners of a building.

However, Applicant has developed a new ladder stabilization apparatus with unique features heretofore unseen, thereby providing an alternative or improvement to the forgoing devices of the prior art.

SUMMARY OF THE INVENTION

According to a first aspect of the invention, there is provided a ladder stabilization apparatus for stabilizing a ladder in an upright position against a structure to which the ladder is not affixed, the stabilization apparatus comprising:

a ladder engagement unit having an attachment mechanism for securing said ladder engagement to the ladder in a stationary position relative thereto;

first and second bracing members attached or attachable to the ladder engagement unit at a side thereof that faces outwardly from a plane of the ladder when secured thereto in the stationary position, each bracing member having a respective contact side for abutting against the structure during stabilization of the ladder;

wherein the bracing members are securable to the ladder engagement unit in two distinct positions mated therewith, including in a first position in which the respective contact sides diverge away from one another in a direction moving outwardly away from the ladder engagement unit and a second position in which the respective contact sides converge toward one another in said direction moving outwardly away from the ladder engagement unit;

whereby placement of the first and second braces in the first position accommodates diverging walls of an outside corner of the structure between the diverging contact sides of the bracing members to stabilize the ladder against said diverging walls of the structure, and placement of the first and second braces in the second orientation accommodates an abutment of converging walls of an inside corner of the structure against the converging contact sides of the bracing members to stabilize the ladder against said converging walls.

Preferably each bracing member has a mounting side lying obliquely to the contact side thereof for abutment of said mounting side against the ladder engagement unit in each of the first and second positions, and a direction in which the mounting side of each bracing member extends along the ladder engagement unit is reversible to accomplish the first and second positions.

Preferably the mounting side of each bracing member and the contact side thereof are disposed at forty-five degrees to one another such that the contact sides of the first and second bracing members are situated at ninety-degrees to one another in both the first and second positions.

Preferably each bracing member is movably coupled to the ladder engaging unit in a manner enabling movement of the bracing member between the first and second positions without full detachment from the ladder engaging unit.

Preferably the ladder engaging unit comprises one or more stop features thereon for normally obstructing movement of the bracing members out of a selected one of the first and second positions in which the engaging members currently reside.

Preferably each bracing member is displaceable toward and away from the ladder engaging unit for movement between a working state abutted against the ladder engaging unit in either one of the first and second positions and a withdrawn state drawn away from the ladder engagement unit, and is rotatable between reversed first and second orientations in the withdrawn state that will place the bracing member in a respective one of the first or second positions upon return of the bracing member toward the ladder engagement unit in a selected one of said first and second orientations.

Preferably each bracing member is biased into the working state.

Preferably the one or more stop features block rotation of the bracing members in the working state.

Preferably the one or more stop features comprise a stop flange projecting outwardly beyond a front wall of the ladder engagement unit against which the bracing members abut in the working state.

Preferably displacement of each bracing member is enabled by relative sliding between the bracing member and the ladder engaging unit along a respective shaft, and a respective spring is coiled around each shaft to bias the respective bracing member and the ladder engagement unit toward one another along said shaft.

Preferably each bracing member comprises a frame having an open center, the ladder engaging unit comprises a hollow structure, each shaft passes through a front wall of said hollow structure and an adjacent side of the respective bracing member that faces toward said front wall of said hollow structure, the shaft is slidable relative to one of said front wall or said adjacent side, and each spring is coiled around the respective shaft between said one of either said front wall or said adjacent side and a stop element that projects outwardly from said shaft adjacent and end thereof on a side of said one of said front wall or said adjacent side that is opposite the other of said front wall or said adjacent side.

Preferably each shaft is defined by a respective bolt, a head of which defines the respective stop element.

Preferably said one of said front wall or said adjacent frame member is said front wall.

Preferably there is a locking mechanism by which the first and second bracing members are lockable in each of the first and second positions.

Preferably the locking mechanism comprises a single locking device by which both the first and second bracing members are locked through a singular actuation of said locking device.

Preferably the single locking device is operable to lock each bracing member in both the first and second positions.

In one embodiment, the single locking device comprises a lock arm pivotally coupled to the ladder engagement unit and having an output end carrying two lock members that respective engage the first and second bracing members. In such instance, preferably each lock member is a lock pin engagable in a hole in a respective one of the first and second bracing members.

In another embodiment, the single locking device comprises a lock arm pivotally coupled to the ladder engagement unit and having a hooked working end, the bracing members have a first pair of protruding portions that overlap in front of the ladder engagement unit in the first position and a second pair of carrying two lock members that overlap in front of the ladder engagement unit in the first position in the second position, and a one of overlapping portions of each pair that resides further from the ladder engagement unit in the respective one of the first and second position is engagable by the hooked working end of the lock arm to lock both bracing members to the ladder engagement unit due to the overlapped relation between said overlapping portions.

Preferably the ladder engagement unit comprises first and second clamping members coupled together and movable relative to one another between a closed-together clamping condition and a more separated open condition, the first and second members being shaped to define a rung-accommodating space between them in the closed-together clamping condition, whereby the ladder engagement unit is attachable to a rung of the ladder by closing the first and second clamping members together around the rung.

Preferably the ladder engagement unit comprises at least one clamp-actuator.

In one embodiment, the clamping members are pivotally coupled together.

In the instance of pivotal clamping members, preferably the at least one clamp actuator comprises at least one quick-release clamp lock operable to secure the clamping members in the closed-together clamping position.

In the instance of pivotal clamping members, preferably the at least one clamp lock comprises at least one over-center fastener.

In the instance of pivotal clamping members, each clamp lock preferably has cooperating components respectively mounted on a movable one of the first and second clamping members and a main body of the ladder engagement unit that resides between the clamping members and the bracing members and to which a stationary one of the first and second clamping members is affixed, and the first and second clamping members are pivotally coupled together at a side of the clamping members opposite the main body.

In another embodiment, the clamping members are linearly displaceable relative to one another, and the at least one clamp actuator comprises at least one screw actuator rotatable in opposing directions to drive linear displacement of the clamping members toward and away from one another.

In one embodiment, each bracing member comprises a pad at the contact side thereof, and the pad is softer than a body of the bracing member to which the pad is removably coupled, whereby use of the apparatus with the pad in place prevents marring or other damage to the walls of the structure.

Preferably each pad is a removable pad mounted to a respective sub-frame that is removably coupled to the body of the bracing member by one or more mechanical fasteners, such as a pin, whereby unfastening of the subframe from the body of the bracing member releases the removable pad from the bracing member.

Preferably the bracing members are positioned to leave an open slot extending toward the ladder engagement unit between said bracing members when both of said bracing members are in the second position, and a width of said open slot slightly exceeds a standardized thickness of dimensional lumber, whereby an upright piece of dimensional lumber is receivable within said open slot to stabilize the ladder relative to the said upright piece of dimensional lumber.

According to a second aspect of the invention, there is provided a ladder stabilization apparatus for stabilizing a ladder in an upright position against a structure to which the ladder is not affixed, the stabilization apparatus comprising:

a ladder engagement unit having an attachment mechanism for securing said ladder engagement to the ladder in a stationary position relative thereto;

first and second bracing members each coupled to the ladder engagement unit by a respective shaft at a side of said ladder engagement unit that faces outwardly from a plane of the ladder when secured thereto in the stationary position;

each bracing member being slidable back and forth along the respective shaft between a working state in which a mounting side of said bracing member is mated with the ladder engagement unit, and a withdrawn state in which said mounting side is retracted away from the ladder engagement unit;

each bracing member being rotatable by at least 180-degrees about an axis of the respective shaft while in the withdrawn state for movement of the bracing member between two reversed orientations about said axis, but prevented from rotating about the axis of the respective shaft when in the working state;

the mounting side of each bracing member being matable with the ladder engagement in both of the reversed orientations about the axis of the respective shaft; and each bracing member having a contact side thereof situated at an oblique angle relative to the contact side thereof such that placement of both of the bracing members in the working state in the first orientation places the contact sides of the bracing members in a condition diverging away from one another in a direction moving outwardly away from the ladder engagement unit, and placement of both of the bracing members in the working state in the second orientation places the contact sides of the bracing members in a condition converging away from one another in a direction moving outwardly away from the ladder engagement unit;

whereby placement of the first and second braces in the working state in the first orientation accommodates diverging walls of an outside corner of the structure between the diverging contact sides of the bracing members to stabilize the ladder against said diverging walls of the structure, and placement of the first and second braces in the working state in the second orientation accommodates an abutment of converging walls of an inside corner of the structure against the converging sides of the bracing members to stabilize the ladder against said converging walls.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1:
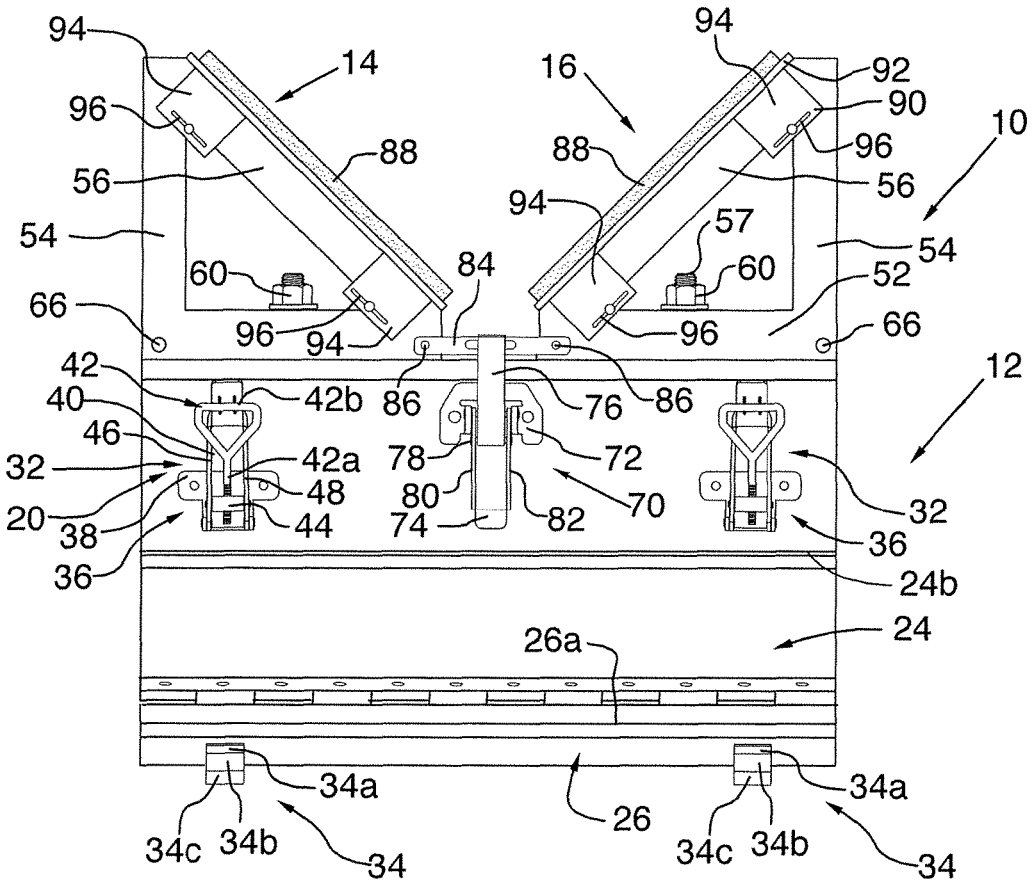
FIG. 1 is a perspective view of a ladder stabilization apparatus according to a first embodiment of the present invention with two adjustable bracing members of the apparatus in a first position for bracing against an outside corner of a building, and with a ladder rung clamp of the apparatus in an open position.
Figure 2:
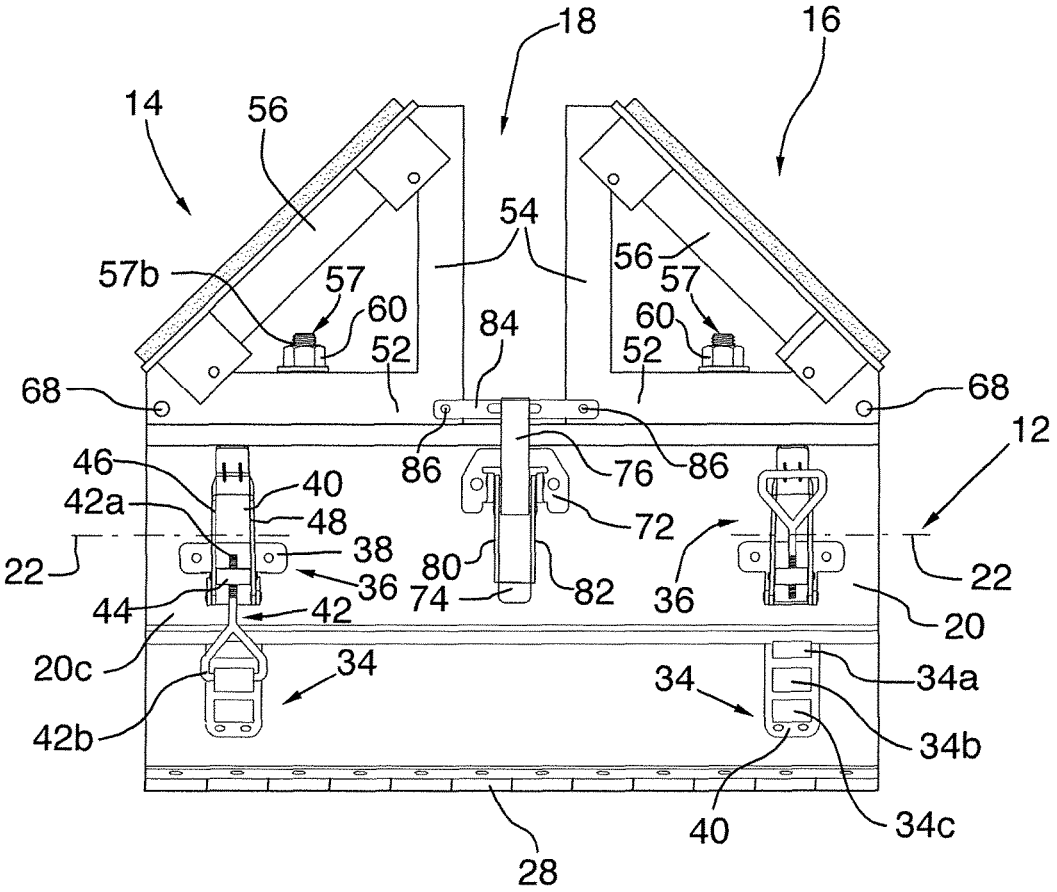
FIG. 2 is a plan view of the ladder stabilization apparatus of FIG. 1 with the two adjustable bracing members thereof in a second position for bracing against an inside corner of a building, and with the ladder rung clamp in a closed position.
Figure 3:
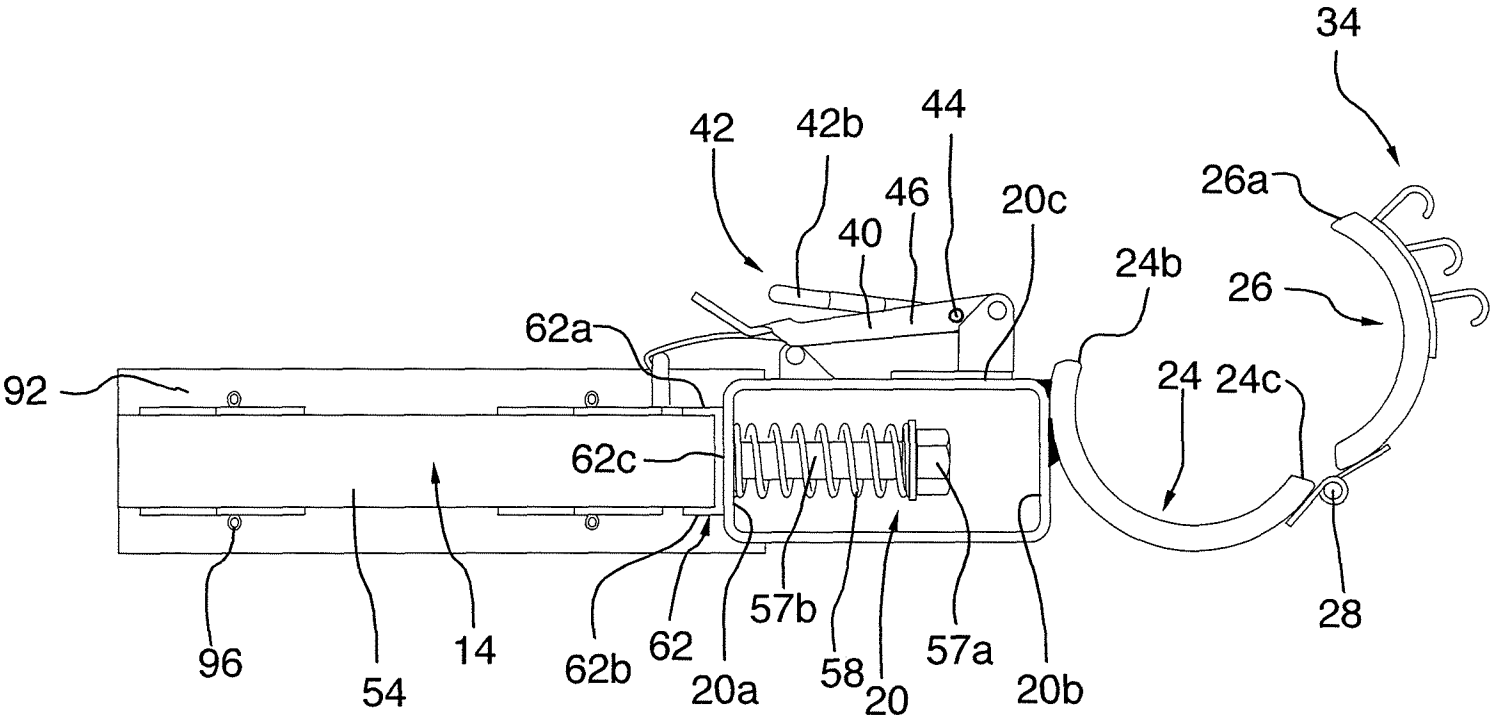
FIG. 3 is a side view of the ladder stabilization apparatus of FIG. 1.

FIGS. 1-3 show a ladder stabilization apparatus 10 according to a first embodiment of the present invention, which features a ladder engagement unit 12 for mounting to a rung of a ladder, and a pair of adjustable bracing members 14, 16 attached to the ladder engaging unit to abut against a structure (e.g. exterior of a building) and stabilize the ladder thereagainst. Each bracing member 14, 16 is shaped as a right-angle triangle that is reversible in position relative to the ladder engagement unit so as to switch whether a hypotenuse of the bracing member's triangular shape faces inwardly toward the other bracing member or outwardly away therefrom. With both triangular bracing members 14, 16 in an inward-facing first position shown in FIG. 1, the hypotenuses of the two bracing members 16, 16 diverge at an angle of ninety degrees to one another in a direction moving away from the ladder engagement unit 12 in order to accommodate an outside right-angle corner of a building or other structure between the bracing members so that the hypotenuses of the bracing members respectively abut with the diverging walls of the building or structure that intersect at the outside corner thereof. With both triangular bracing members 14, 16 in an outward-facing second position shown in FIG. 2, the hypotenuses of the two bracing members 16, 16 converge toward one another at ninety degrees in the direction moving away from the ladder engagement unit in order to accommodate to enable abutment of the hypotenuses against two converging walls of a building that form an inside corner thereof. In the outward-facing second position of FIG. 2, a slot-shaped opening 18 is left between the two triangular bracing members 14, 16 at the facing together sides thereof, and is sufficiently wide to accommodate the thickness of 2-inch piece of dimensional lumber (e.g. 2×4, 2×6, 2×8, 2×10, 2×12, etc.). A ladder on which the apparatus 10 is installed can therefore be leaned against, and stabilized on, an inner or outer corner of a finished building or other structure, or against a dimensional framing member of a framed (but unfinished) building or other structure.

The ladder engagement unit in the first embodiment features an elongated piece of rectangular metal tubing defining an open-ended closed-sided channel 20 having longitudinal axis 22 extending through the two open ends of the channel. The two bracing members 14, 16 are carried on the closed channel 20 at one of the closed sides thereof, which is hereinafter referred to as a front wall 20*a* of the closed channel 20. At an opposing closed side of the closed channel 20, hereinafter referred to as a rear wall 20*b* of the closed channel, a pair of arc-shaped clamping members cooperatively form a rung clamp for enabling removable attachment of the apparatus 10 to a ladder. The closed channel 20 therefore defines a hollow main body of the apparatus residing between the bracing members and rung clamp mounted thereto, and is therefore also referred to herein as the main body channel. A stationary one of the arc-shaped clamping members 24 is affixed to the rear wall 20*b* of the channel 20, while a movable one of the arc-shaped clamping members 26 is pivotally coupled to the stationary clamping member 24 by hinge 28. The movable clamping member 26 is therefore pivotal relative to the stationary clamping member 24 about a pivot axis 30 of the hinge 28, which lies parallel to the longitudinal axis 22 of the main body channel 20.

Each clamping member is of elongated character in the same direction as the main body channel 20, for example having a similar or equal length thereto in this direction. The arc-shaped characteristic of each clamping member refers to its cross-section in planes normal to the longitudinal direction in which the channel and hinge axes lie. The movable clamping member 26 is hinged to the stationary clamping member 24 at a distal end 24*a* thereof that lies opposite to its fixed attachment to the main body channel 20. The arc-shaped cross-section of the stationary clamping member spans approximately 180-degrees, while the arc-shaped cross-section of the movable clamping member has a lesser angular span and smaller radius. The shorter span of the movable clamping member is such that a free end 26*a* of the movable clamping member 26 situated opposite to the hinged end thereof does not impact against the channel-adjacent end 24*b* of the stationary clamping member, but instead can move therepast and engage against the concave interior side of the stationary clamp member to define a fully-closed position of the clamp, in which an open space of oblong cross-section is delimited between the two clamping members.

In the first embodiment, two quick release clamp locks 32 are provided for locking the rung clamp in a closed position around a rung of ladder. Each quick release clamp lock 32 is an over center fastener featuring a catch unit 34 affixed to the convex exterior side 26*c* of the movable clamp member 26 and a cooperating lever unit 36 mounted to the main body channel 20 at a top wall 20*c* thereof that perpendicularly joins together the front and rear walls 20*a*, 20*b* and faces a same direction as the concave interior of the stationary clamping member 24. Each catch unit 34 features a set of multiple catch tabs 34*a*, 34*b*, 34*c* affixed to and projecting away from the exterior of the movable clamping member 26. Each catch tab bends or curves away from the free end 26*a* of the movable clamping member 26 toward the hinged end thereof.

Each lever unit 36 features a base plate 38 affixed to the main body channel, a lever 40 pivotally coupled to lugs of the base plate 38 for movement about a pivot axis that is parallel to the hinge axis, and a latch arm 42 that is coupled to the lever 40. The latch arm 42 features a shaft 42*a* that lies perpendicular to the pivot axis of the lever 40 and is mated with a rotatable pin 44 carried between two parallel legs 46, 48 of the lever, which in turn are pivotally pinned to the lugs of the base plate 38. The pin 44 is rotatable on a pin axis that is parallel to the pivot axis of the lever, and is positioned intermediately between the lug-carried ends of the legs 46, 48 and a free end of the lever that is situated distally of its pinned connection to the lugs of the base plate. At the end of the latch arm shaft 42*a* opposite the pin 44, the latch arm 42 features a rigidly closed loop 42*b* for hooking over a selected one of the three catch tabs of the respective catch unit 34.

FIG. 1 shows the rung clamp in an open position with the latch arms 42 of the two over-center fasteners disengaged from the catch tab units to enable receipt of a ladder rung between the two clamping members, whereupon the movable clamping member is pivotable toward the fully closed position so that the two clamping members reside above and below the selected ladder rung. To lock the clamping mechanism tight on the ladder rung, the free end of each lever 40 is pivoted toward the rung clamp around the lever's pivot axis, during which the pin 44 is carried over-center of the lever's pivot axis, and the closed-loop end 42*b* of the respective latch arm 42 is accordingly carried toward the rung clamp with the lever. The user hooks the closed-loop end 42*b* of the latch arm 42 over a selected one of the catch tabs 34*a*, 34*b*, 34*c* of the respective catch unit, and then pivots the lever 40 back toward the bracing members 14, 16, thereby moving the pin 44 back over-center of the lever's pivot axis, which causes the latch arm 42 to pull the catch tab 34*a*/34*b*/34*c* on the movable clamping member toward the main body channel 20. This closes the ladder rung tightly between the two clamping members 24, 26, and the over-center position of the pin 44 on the side of the lever pivot axis opposite the rung clamp acts to lock the rung clamp in a tightly clamped condition on the ladder rung to hold the apparatus 10 on the ladder in a position with the main body channel 20 and the bracing members 14, 16 jutting outwardly to one side of the ladder. The over center-position of the latch-carrying pin 44 at more than 180-degrees around the lever's pivot axis from the catch tab keeps the rung clamp locked in the clamped condition on the ladder rung until the lever is pulled back toward the rung clamp with sufficient manual force to overcome the over-center bias of the fastener.

Each bracing member 14, 16 features an open-framed triangular structure with three linearly extending frame members, e.g. formed of square metal tubing, which are connected end to end with one another to define respective sides the overall triangular shape of the bracing member. The three frame members include a mounting member 52 lying parallel to the front side of the main body channel 20 to define a mounting side of the bracing member, a side member 54 perpendicularly attached to the mounting member 52 at one end thereof to define a perpendicular side of the bracing member, and a diagonal member 56 obliquely connecting the other two frame members at 45-degrees in order to define a diagonal side of the bracing member that forms a right-angle isosceles triangle with the other two sides. The "opened-framed" aspects of the of the bracing member of the first illustrated embodiment refers to the fact that the center space delimited by the frame members is substantially unoccupied, which enables attachment of each bracing member to the main body channel 20 of the ladder engagement unit 10 through the mounting member 52 of the bracing member's triangular frame.

This attachment of each bracing member 14, 16 to the ladder engagement unit features a respective bolt 57 passing perpendicularly through the mounting member 52 of the bracing member 14, 16 from the unoccupied central space of the triangular frame and into the enclosed interior space of the main body channel 20 through the closed front wall 20*a* thereof. With specific reference to FIG. 3, the head 57*a* of the bolt is disposed inside the main body channel 20, and a compression spring 58 is coiled around the shaft 57*b* of the bolt 57 so as to reside between the bolt head 57*a* and the closed front wall 20*a* of the main body channel. The bolt head acts as a stop element projecting outwardly from the bolt shaft to contain the spring in place between the bolt head and channel wall and enable exertion of the spring force on the bolt that carries the bracing member.

Under the action of the spring 58, the bolt 57 is biased rearwardly toward the closed rear wall 20*b* at which the stationary clamping member 24 of the rung clamp is externally mounted. The shaft 57*b* of the bolt 57 extends through the front wall 20*a* of the main body channel 20 and onward through the mounting member 52 of the respective bracing member frame, where a nut 60 is then engaged on the end of the bolt shaft within the unoccupied center space of the bracing member frame. The nut 60 exceeds the diameter of the hole in the mounting member 52 through which the bolt shaft 57*b* extends, thereby defining a stop that prevents the bracing member from sliding off the end of the bolt shaft, and likewise prevents pulling of the end of the bolt shaft through the mounting member 52. As a result, the compression spring 58 disposed around each bolt 57 biases the respective bracing member 14, 16 toward the main body channel 20, and thus toward the rung clamp situated therebehind, but allows the bracing member 14, 16 to be pulled forwardly away from the front wall 20*a* of the main body channel 20 against the force of the spring.

A forwardly opening U-shaped stop channel 62 is affixed to the exterior of the main body channel's front wall 20*a* with parallel side walls 62*a*, 62*b* of the stop channel 62 projecting perpendicularly and forwardly outward from the plane of the main body channel's front wall 20*a*. The parallel walls 62*a*, 62*b* delimit an open end the stop channel 62 that is situated opposite the main body channel's front wall 20*a* at the distal ends of the stop channel walls 62*a*, 62*b*. An intermediate wall 62*c* joining together the two parallel walls 62*a*, 62*b* of the stop channel 62 is affixed flush against the exterior surface of the front wall 20*a* of the main body channel 20.

The longitudinal direction of the stop channel 62 lies parallel to that of the main body channel, whereby each stop channel wall 62*a*, 62*b* runs longitudinally of the main body channel's front wall. A distance between the stop channel walls 62*a*, 62*b* slightly exceeds the thickness of the frame of each bracing member 14, 16, whereby the mounting member 52 of each bracing member frame is receivable between the parallel stop channel walls 62*a*, 62*b*. Each compression spring 58 thus biases the respective bracing member 14, 16 into a working state in which the respective mounting member 52 of the bracing member frame abuts against the intermediate wall 62*c* of the stop channel 62 at the front side of the main body channel 20, thereby denoting a mated-together condition between the ladder engagement unit 12 and the bracing member 14, 16. Each bracing member is manually retractable away from the ladder engagement unit against the spring force, thereby withdrawing the mounting member 52 out of and away from the stop channel 62.

In such a withdrawn position, each bracing member 14, 16 is rotatable about the axis of the respective bolt shaft 57*b*. However, in the working state, rotation of each bracing member 14, 16 about the respective bolt shaft is prevented by the parallel walls 62*a*, 62*b* of the stop channel. The parallel walls of the stop channel 62 therefore define stop features of the ladder engagement unit that prevent rotation of the bracing members 14, 16. Accordingly, to switch each bracing member 14, 16 between the first inward-facing position of FIG. 1 and the reversed outward-facing position of FIG. 2, the bracing member is manually pulled away from the ladder engagement unit into the withdrawn position, and manually rotated 180-degrees around the axis of the respective bolt shaft 57*b*. At this point, the manual pulling force is reduced or removed, whereupon the spring force of the respective compression spring 58 draws the bracing member 14, 16 back into the working state mated with the stop channel 62 of the ladder engagement unit 12. This retract-and-rotate action is performed on each of the two bracing members in order to place them both in the selected one of either the inward-facing first position of FIG. 1 or the outward-facing second position of FIG. 2.

As an alternative to the described placement of the spring 58 inside the main body channel 20 member to slide the bolt shaft 57*b* rearwardly through the hole in the front wall 20*a* of the main body channel so that the respective bracing members slides rearwardly with the bolt, the bracing member could be slidably disposed on a stationary shaft. In such an alternate embodiment, the bolt head could be welded or otherwise affixed to the main body (which would not necessarily have to include a closed-channel or other hollow body), and the spring placed around the bolt shaft inside the open central space of the bracing member frame between the nut 60 and the mounting member 52 so that the spring urges the bracing member toward the main body along the stationary bolt shaft. In such instance, the nut 60 would define the stop element that maintains the spring 58 in place. In either embodiment, relative sliding between the bracing member and the shaft enables linear displacement of the bracing member relative to the main body into and out of the working state, while the shaft also allows rotation of the bracing member relative to the main body between the first and second inward-facing and outward-facing orientations.

With the apparatus fastened to a ladder by the rung clamp so as to project forwardly from the ladder to abut against either an inside or outside corner of a building or other structure and thereby stabilize the ladder in a position leaning against the building or structure, the reaction force from the building or structure against this leaning action of the ladder supplements the spring force so as to further urge the bracing members 14, 16 into the working state safely held against rotation by the stop channel 62. However, as an extra safety precaution to prevent the bracing members from rotating out of position around their respective bolt shafts 57*b*, a locking mechanism is provided to lock the bracing members in the working state, and thereby cooperate with the stop channel to maintain the selected one of either the inward-facing first position or outward-facing second position of the bracing members 14, 16.

In the illustrated embodiment, the locking mechanism uses a singular locking device 64 to lock both of the bracing members 14, 16 in place through a singular actuation of the device. The locking device in the illustrated example is an over-center latch that performs a similar quick-release locking action to the over-center quick release fasteners of the rung clamp. However, the locking device 64 lacks any catch tabs on the bracing members, and instead employs two pairs of locking holes in the mounting members 52 of the two bracing members 14, 16. One pair of locking holes 66 are defined at the corners of the bracing member frames where the mounting members 52 join up with the side members 54, while the other pair of locking holes 68 are defined at the corners of the bracing member frames where the mounting members 52 join up with the diagonal members 56 of the bracing member frames.

For cooperation with the locking holes 66, 68, the locking device features a latching unit 70 attached to the main body channel 20, for example on the same top wall 20*c* thereof as the lever units 36 of the quick release clamp locks 32 for the rung clamp. The latching unit 70 is centrally located between the lever units 36, and features a base plate 72 attached to the main body channel 20, a handle 74 pivotally coupled to the base plate 72 via a pair of lugs thereon for pivoting of the handle 74 about an axis parallel to the pivot axis of the quick release rung clamp locks, and a curved lock arm 76 mated with a rotatable pin 78 that is carried between two parallel legs 80, 82 of the handle 74, which in turn are pivotally pinned to the lugs of the base plate 72. The pin 78 is rotatable on a pin axis that is parallel to the pivot axis of the handle 74 at a location disposed intermediately between the lug-carried ends of the legs 80, 82 and a free end of the handle situated distally of its pinned connection to the lugs of the base plate 72. At the end of the lock arm 76 opposite the pin 78, the lock arm 76 features a cross-bar 84 that lies perpendicularly transverse of the lock arm 76 and carries a pair of pin-shaped lock members 86 at or near opposing ends of the cross-bar 84. Each pin-shaped lock member has a diameter slightly less than that of each of the lock holes 66, 68 in the bracing members 14, 16.

To lock the bracing members in the working state, the free end of the handle 74 is pivoted toward the bracing members around the handle's pivot axis, during which the pin 78 is carried over-center of the handle's pivot axis, and the cross-bar 84 of the lock arm 76 is accordingly carried toward the bracing members with the handle. The user inserts the pin-shaped locking members 86 of the cross-bar 84 into the set of lock holes currently residing nearest the center of the main body channel (as determined by whether the bracing members are currently in the inward-facing first position or outward-facing second position), and then pivots the handle 74 back toward the rung clamp at the rear of the main body channel. This action moves the pin 78 back over-center of the handle's pivot axis and thereby pulls the mounting members 52 of the bracing member frames toward the main body channel 20 and into the stop channel 62 at the front side thereof via the lock arm's cooperation with the engaged lock holes 66, 68. This locks the two bracing members 14,16 in the working state matingly received in the stop channel 62, where the parallel side walls 62*a*, 62*b* of the stop channel 62 block rotation of the bracing members 14, 16 out of the selected first or second position. The over center-position of the lock arm pin 78 at more than 180-degrees around the handle's pivot axis from the hole-equipped mounting members 52 of the bracing member frames keeps the bracing members 52 locked in the rotation-preventing working state until the handle 74 is pivoted back toward the bracing members 14, 16 with sufficient manual force to overcome the over-center bias of the lock.

FIGS. 1-3 show a pair of removable pads 88 installed on the diagonal members 56 of the bracing member frames. Each paid 88 is carried by a respective sub-frame 90 that is detachably coupled to the diagonal member 56 of the corresponding bracing member frame. Each pad 88 comprises a sheet or cushion of softer material than the bracing member frame and corresponding sub-frame, and may for example be a resiliently compressible material. With the pads in place, potential marring or damage to finished exterior cladding (e.g. siding) of a building or other structure that might otherwise occur under direct contact of the cladding with the frames of the bracing members 14, 16 is prevented. In other applications where the type of the cladding material involved is less susceptible to damage, the pads may optionally be removed.

Each sub-frame 90 in the illustrated embodiment features a main rectangular plate 92 to which a respective pad is secured (e.g. adhesively, or by hook and loop fastener) on a face of the plate, and four planar mounting legs 94 projecting from an opposing face of the plate near the four corners thereof. Two legs overlie the respective bracing member frame in a plane parallel thereto, and align with the other two legs which underlie the respective bracing member frame in another plane parallel thereto. Each planar leg 94 has a respective through-hole therein that matches up with a corresponding through hole in the aligned planar leg on the opposite side of the bracing member frame. At each pair of aligned planar legs 94, a lock pin 96 (e.g. cotter pin) is passed through the pair of aligned holes in these legs. To accommodate this, each planar leg 94 extends sufficiently far inward from the outer side of the diagonal member 56 of the bracing member frame to reach the open central space of the bracing member frame. The lock pin 96 thus traverses through the open central space of the bracing member frame in order to pin the aligned pair of planar legs 94 together and thereby secure the sub-frame 90 to the diagonal frame member 56. The pads 88 on the sub-frames 90 are therefore easily removed by withdrawal of the lock pins 96 and pulling of the sub-frames 90 off the respective diagonal frame members 56 of the bracing member frames.

The diagonal members of the bracing member frames, alone or in combination with the optional pads installed thereon, thus define contact sides of the bracing members that are used for abutment against the inside or outside corner of a building or other structure, while the mounting members 52 lie obliquely to the diagonal frame members 56 at forty-five degrees thereto so as to matingly abut against the ladder engagement unit 10 at a front side thereof that lies parallel to the rungs of the ladder. The padded or unpadded contact sides of the two bracing members 14, 16 lie at right angles to one another in both of the first and second positions, which differ primarily in that the contact sides diverge from one another in a direction moving forwardly away from the ladder engagement unit in the first position, and converge toward one another in the direction moving forwardly away from the ladder engagement unit in the second position. With reference to FIG. 2, a distance from the axis of the bolt-shaft 57*b* of each of the two identical bracing members 14, 16 to the outer-side of the respective side member 54 (i.e. the side thereof that faces outwardly from the central space of the bracing member frame) is less than half of the distance between the axes of the two bolts 57, thereby leaving the slot-shaped opening 18 between the two bracing members 14, 16 when in the outward-facing second positions. This slot 18 is slightly greater than 1.5-inches in width, which is the finished thickness of 2-inch thick dimensional lumber. Accordingly, with the apparatus installed on a ladder, the slot 18 can be slid into place over the edge of a wall stud or other upright piece of 2-inch thick dimensional lumber, whereby the side members 54 of the two bracing members 14, 16 embrace opposing sides of the stud in order to stabilize the ladder against lateral tilting. The apparatus is thus not limited to use in outside or inside corner situations where the diagonal contact sides of the bracing members stabilize the ladder against lateral tilting through contact with wall surfaces of the building or structure.

FIGS. 4 through 8 illustrate a second embodiment of the ladder stabilization apparatus 10' which similarly has a ladder engagement unit 12' having a main body 20' and a pair of clamping members 24', 26' coupled thereto for attaching the apparatus to the run of a ladder, and a pair of generally triangular bracing members 14', 16' movably coupled to the opposing side of the main body and adjustable between first and second positions. The general layout and function of the second embodiment is thus substantially identical to the first. The particular construction and operation of the second embodiment differs from the first in a few ways, however. Among these differences, the clamping members 24', 26' are arranged for linear displacement rather than pivotal movement relative to one another during opening and closing of the clamp, the frames of the main body 20' and the bracing members 14', 16' are formed of metal sheeting or plate material rather than metal channel or tubing.

The main body 20', though not formed by singular unitary piece of metal channel or tubing, is once again a hollow structure with a front wall 20*a*, an opposing rear wall 20*b* parallel thereto, and opposing top and bottom walls 20*c*, 20*d* that perpendicularly span between the front and rear walls. In the second embodiment, each wall is made of laser-cut metal plating or sheeting, which as shown may feature cut-out areas to reduce the overall weight of the unit, with various walls being fastened together by rivets 97

Each bracing member 14', 16' is likewise assembled from laser-cut pieces of metal plating or sheeting riveted together to form an open frame. The generally triangular outer form of each bracing member has a mounting side 52' for abutting against the front wall 20*a* of the main body 20' in the working state, a perpendicular side 54' lying perpendicular to the mounting side, and a diagonal side 56' extending diagonally between the mounting side and the perpendicular side. These sides respectively correspond to those defined by the mounting member, side member and diagonal member of each bracing member in the first embodiment. Like the open-frame structure of the first embodiment brace members, the second embodiment brace members 14', 16' have open center spaces accommodating passage of the bolts 57 into the interior spaces of the two generally triangular brace members through the mounting sides 52' thereof. In the same way as the first embodiment, the bolts 57 guide sliding of the brace members between their working states and the withdrawn positions, while the springs 58 bias the brace members into their working states.

Figure 5:
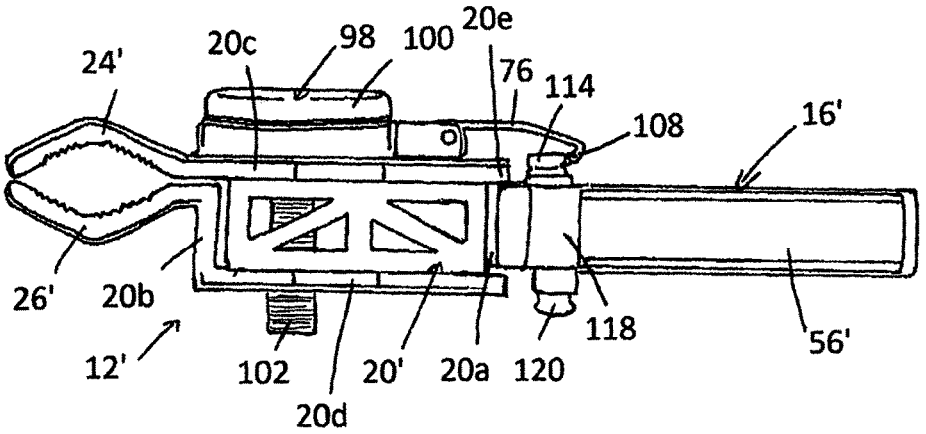
FIG. 5 is a side view of the second embodiment ladder stabilization apparatus of FIG. 4.

The second embodiment features a stationary clamping member 24' fixed to the main body 20' of the ladder engagement unit, but the concave side of the stationary clamping member 24' faces downwardly from the plane of the top wall 20*c* of the main body 20' toward the plane of the opposing bottom wall 20*d*. Instead of the movable clamping member 26 being hinged to the stationary clamping member, the movable clamping member 26 is affixed to the bottom wall 20*d* of the main body 20' that lies opposite and parallel to the top wall 20*c*. To enable the opening/closing movement of the clamp, the main body in this embodiment is an expandable/collapsible unit in which the bottom wall 20*d* is displaceable toward and away from the top wall 20*c* on an axis normal to the parallel planes of these walls, thereby enabling collapse and expansion of the main body 20' in a height dimension measured between these walls. The rear wall 20*b* of the main body 20 is affixed to the movable bottom wall 20*d*, while the front wall 20*a* of the main body is affixed to the stationary top wall 20*c*. Instead of having a connection to the top wall like in the first embodiment, the rear wall 20*b* carries the movable clamping member 26 at the top end of the rear wall, where the movable clamping member 26' cantilevers out from the main body 20' in a concave-side-up orientation facing toward the stationary clamping member 24'. The concave side of each clamping member is serrated, as best shown in FIG. 5, to provide optimal gripping on a ladder rung.

Expansion of the main body in the height direction thus lowers the movable clamping member 26' away from the stationary clamping member 24' in order to open the clamp to accommodate receipt of a ladder rung therein, whereupon collapse of the main body 20' in the height direction displaces the movable clamping 26' member back toward the stationary clamping member to close the clamp on the ladder rung.

Figure 7:
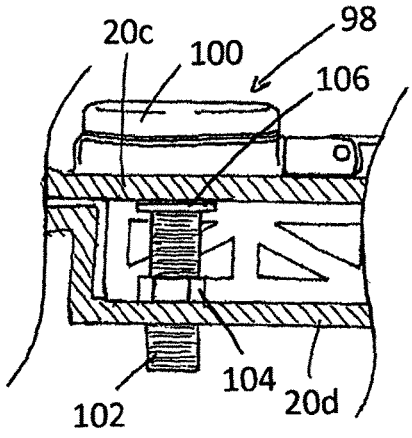
FIG. 7 is a partial cross-sectional view of the second embodiment ladder stabilization apparatus FIG. 6 as viewed along line A-A thereof.

To control this collapse/expansion of the main body and corresponding closing/opening of the clamp, there are two screw actuators 98 each located adjacent a respective end of the main body 20'. Each screw actuator 98 features a knob-shaped actuator handle 100 residing atop the top wall 20*c* of the main body, from which a threaded shaft 102 extends downward through the interior space of the hollow main body 20' and onward through the bottom wall 20*d* via a threaded bore, for example as defined by a threaded nut 104 fixed to the bottom wall as shown in FIG. 7. A stop collar 106 on the threaded shaft 102 projects radially outward therefrom inside the main body 20' just beneath the top wall 20*c* thereof. This top collar 106 cooperates with the knob-shaped actuator handle 100 on the other side of the top wall 20*c* to block axial displacement of the screw actuator 98 in either direction. The axes of the actuator shafts 102 are orthogonal to the top and bottom walls 20*c*, 20*d* of the main body 20', and define the axes along which the bottom wall 20*d* is displaceable relative to the top wall. Rotation of the knob-shaped actuator handles 100 in one direction draws the bottom wall 20*d* and attached movable clamp member 26' upwardly toward the top wall 20*c* of the main body 20' to collapse same and close the rung clamp. Rotation in the other direction pushes the bottom wall 20*d* downwardly away from the top wall 20*c* of the main body 20' to expand same and open the rung clamp. The screw actuators 98 thus replace the quick-release lever-based clamp locks 32 of the first embodiment for tightening the clamp into a closed position around a ladder rung.

Figure 4:
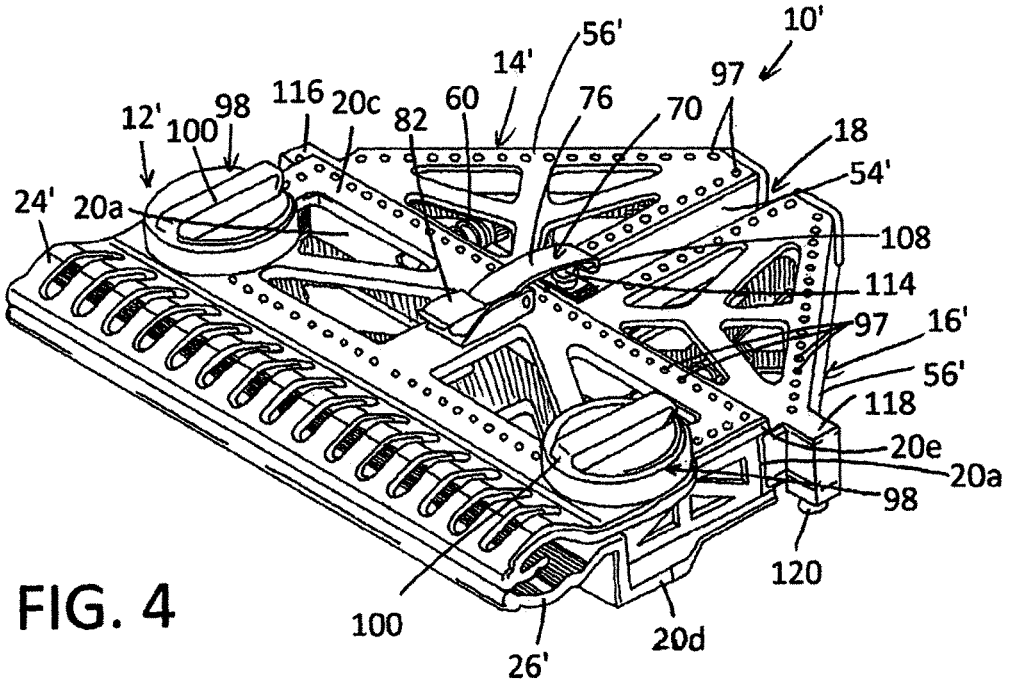
FIG. 4 is a perspective view of a second embodiment ladder stabilization apparatus with the adjustable bracing members in the second position and the ladder rung clamp in the closed position.
Figure 6:
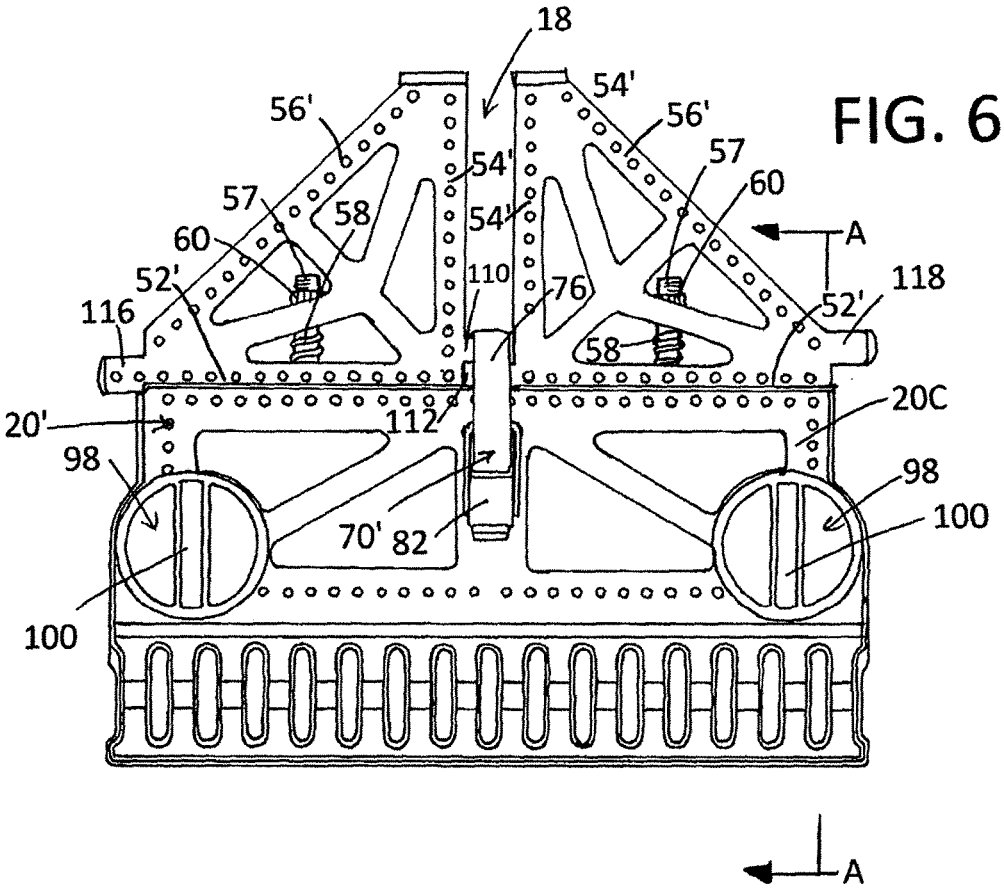
FIG. 6 is a plan view of the second embodiment ladder stabilization apparatus of FIG. 4.

The latching unit 70' of the second embodiment differs from that of the first embodiment in that instead of the working end of the lock arm 76' having a cross-bar with a pair of pin-shaped lock members respectively engaging lock holes in the two bracing members 14', 16', the lock arms 76' instead has a curved hooking end 108 at which it curves back alone itself at the underside of the lock arm. With reference to FIG. 6, bracing member 14 has a built-out block-shaped protrusion 110 on its perpendicular side 54' near, but spaced from the corner where the perpendicular side meets the mounting side 52'. Bracing member 16 likewise has a built-out block-shaped protrusion 112 on its perpendicular side 54' at the corner where the perpendicular side meets the mounting side 52'. In the outward-facing second position of the bracing members, as shown in FIG. 6, the block-shaped protrusion 110 of bracing member 14' fits over the block-shaped protrusion 112 on the side thereof opposite the main body 20' of the ladder engagement unit at the inner end of the slot-shaped opening 18 that otherwise exists between the two bracing members 14', 16'. In the over-center locking position of the lock arm 76', the hooking end 108 of the lock arm hooks over the head of a knob-shaped catch 114 that is mounted atop the block-shaped protrusion 110 of bracing member 14, as shown in FIG. 4. The hooking end 108 of the lock arm thus holds the bracing member 14' in the working state by locking onto its block-shaped protrusion 110, which in turn blocks pulling of the other bracing member out of the working state by way of the overlapping positions of the block-shaped protrusions on the two bracing members.

Bracing member 14' also features a second built-out block-shaped protrusion 116 at the corner where the diagonal side 56' meets with the mounting side 52'. Likewise, bracing member 16' features a second built-out block-shaped protrusion 116 at its diagonal side 56' near, but spaced from, the corner where it meets the mounting side 52'. In the outward-facing second positions of the bracing members, shown in FIG. 9, protruding block 118 of bracing member 16' fits over protruding block 116 of the other bracing member 14' on the side thereof opposite the main body 20' of the ladder engagement unit at the inner end of the generally triangular space left open between the facing-together diagonal sides of the bracing members. The hooking end 108 of the locking arm 76' hooks over the head of another knob-shaped catch 120 mounted on the block-shaped protrusion 118 of bracing member 16', which can be best seen in FIG. 5. The hooking end 108 of the lock arm 76' thus holds the bracing member 16' in the working state by locking onto its block-shaped protrusion 118, which in turn blocks pulling of the other bracing member 14' out of the working state due to the overlapping positions of the two diagonal-side block-shaped protrusions of the two bracing members.

Figure 8:
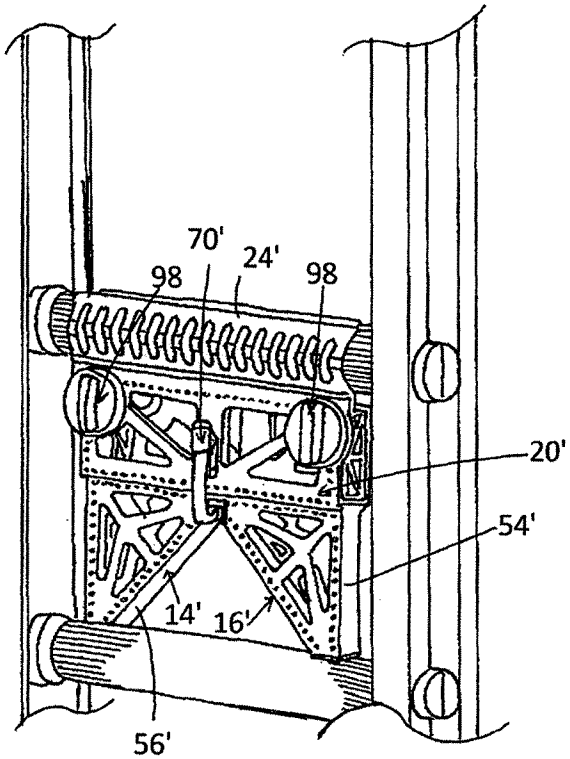
FIG. 8 is a perspective view of the second embodiment ladder stabilization apparatus clamped to a ladder rung in a storage position.

FIG. 8 shows the apparatus installed on a ladder in a storage position. Here, the clamp is attached to one rung of the ladder and the main body 20' and bracing members 14', 16' hang down toward to a second rung located below the first, whereby the apparatus extends parallel to the two rails of the ladder and is contained entirely between the two rails without protruding outward from the ladder in any direction.

Figure 9:
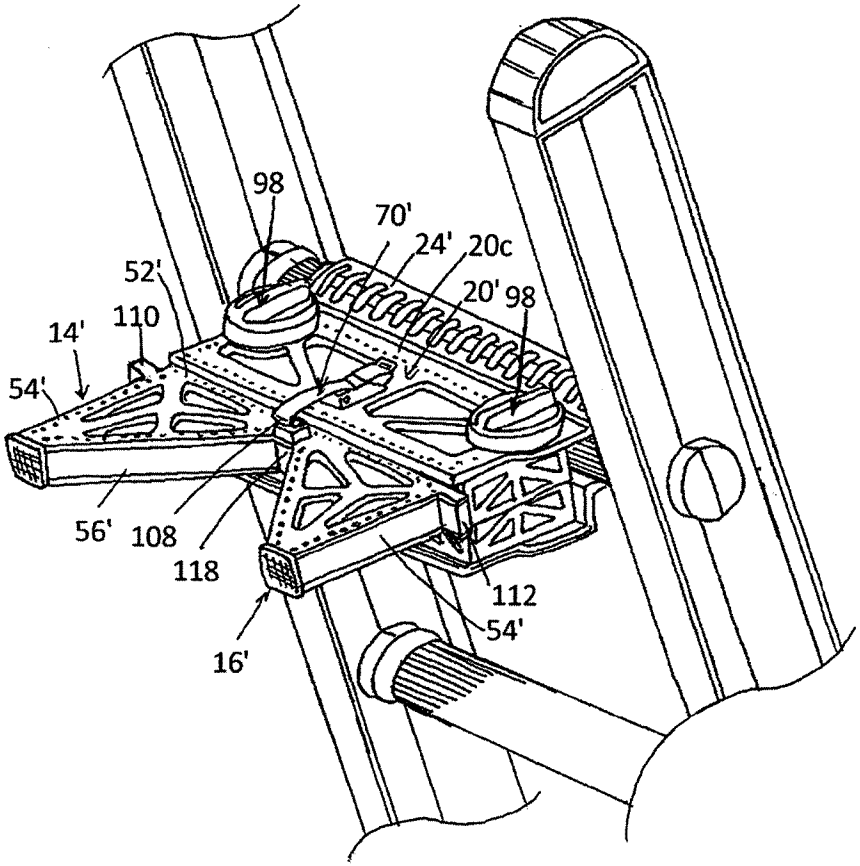
FIG. 9 is a perspective view of the second embodiment ladder stabilization apparatus clamped to a ladder rung in a working position with the bracing members in the first position for use of the ladder at an outside corner of a building.

FIG. 9 on the other hand shows the apparatus installed on the ladder in a working position reaching laterally out to one side of the top rung of the ladder with the bracing members 14', 16' in the inward-facing first positions for bracing the ladder against the outside corner of a building or other structure. The apparatus is switchable from the storage position of FIG. 8 to the working position of FIG. 9 by simple manual loosening of the screw actuators 98 to loosen the clamped condition of the apparatus on the ladder rung, and pivoting of the apparatus about the axis of the ladder rung and out of the inter-rung space of the ladder into the projecting position reaching outward at one side thereof. The screw actuators 98 are then re-tightened in order to firmly secure the apparatus in this working position. The first embodiment is operable in the same manner between storage and working positions, but with use of the quick-release clamp locks 32 instead of the screw actuators to release and then re-lock the clamped condition of the ladder engagement unit on the ladder rung.

Instead of the stop channel 62 of the first embodiment, the second embodiment features an overhanging portion 20*e* of the top wall 20*c* of the main body 20' that reaches forwardly beyond the front wall 20*a* in order to block rotation of either bracing member when in the working state. Like each stop channel wall 62*a*, 62*b* of the first embodiment, this overhanging portion of the top wall of the main body thus forms a stop flange spanning across the front of the main body 20' in a manner projecting forwardly outward from the front wall 20*a* to block rotation of either bracing member when in the working state.

While the illustrated embodiments feature bracing members that are slidably coupled to the ladder engagement unit via shafts by which the bracing members slide into an out of a mated working state with the ladder engagement unit without full detachment therefrom, it will be appreciated that the bracing members could alternatively be fully detachable from the ladder engagement unit and then re-attached thereto in a selected one of the first or second positions. However, the illustrated embodiments avoid the need for the user to fully unfasten and re-fasten the bracing members to the ladder engagement unit, instead allowing a simple pull-and-turn operation to reverse the position of each bracing member and simple lever-like manipulation of the locking mechanism to lock the bracing members in the selected position. While the illustrated embodiments employ a rung-based clamp to defined an attachment mechanism or securing the apparatus to a ladder, it will be appreciated that similar use of reversible bracing members may be employed in embodiments that alternatively use an attachment mechanism that is configured to couple to the rails of the ladder. It will also be appreciated that the particular shape of the bracing members may vary from the triangular configuration of the illustrated embodiments while still employing a mounting side that mates with the ladder engagement unit in a direction parallel to the ladder rungs and a diagonal side for bracing against the building or other structure. In embodiments where the bracing members are fully detachable, transition of the bracing members from the first position to the second position, and vice versa, may be performed by switching which one of the two perpendicular sides 52, 54 is mounted to the ladder engagement unit, rather than reversing the orientation of a same singular side 52 that is used to mount the bracing member in both positions.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A ladder stabilization apparatus for stabilizing a ladder in an upright position against a structure to which the ladder is not affixed, the stabilization apparatus comprising:

a ladder engagement unit having an attachment mechanism for securing said ladder engagement unit to the ladder in a stationary position relative thereto;

first and second bracing members attached or attachable to the ladder engagement unit at a side thereof that faces outwardly from a plane of the ladder when secured thereto in the stationary position, each bracing member having a respective contact side for abutting against the structure during stabilization of the ladder;

wherein:

the bracing members are movably coupled to the ladder engagement unit in a manner enabling movement of the bracing members between two distinct positions without full detachment from the ladder engagement unit, including in a first position in which the respective contact sides diverge away from one another in a direction moving outwardly away from the ladder engagement unit and a second position in which the respective contact sides converge toward one another in said direction moving outwardly away from the ladder engagement unit;

each bracing member is displaceable toward and away from the ladder engagement unit for movement between a working state abutted against the ladder engagement unit in either one of the first and second positions and a withdrawn state drawn away from the ladder engagement unit, and is rotatable between reversed first and second orientations in the withdrawn state that will place the bracing member in a respective one of the first or second positions upon return of the bracing member toward the ladder engagement unit in a selected one of said first and second positions; and each bracing member is biased into the working state;

whereby placement of the first and second bracing members in the first position accommodates diverging walls of an outside corner of the structure between the diverging contact sides of the bracing members to stabilize the ladder against said diverging walls of the structure, and placement of the first and second bracing members in the second position accommodates an abutment of converging walls of an inside corner of the structure against the converging contact sides of the bracing members to stabilize the ladder against said converging walls.

2. The apparatus of claim 1 wherein each bracing member has a mounting side lying obliquely to the contact side thereof for abutment of said mounting side against the ladder engagement unit in each of the first and second positions, and a direction in which the mounting side of each bracing member extends along the ladder engagement unit is reversible to accomplish the first and second positions.

3. The apparatus of claim 2 wherein the mounting side of each bracing member and the contact side thereof are disposed at forty-five degrees to one another such that the contact sides of the first and second bracing members are situated at ninety-degrees to one another in both the first and second positions.

4. The apparatus of claim 1 wherein the ladder engagement unit comprises one or more stop features thereon for obstructing movement of the bracing members out of a selected one of the first and second positions in which the bracing members reside.

5. The apparatus of claim 1 wherein the ladder engagement unit comprises one or more stop features thereon for blocking rotation of the bracing members in the working state.

6. The apparatus of claim 5 wherein the one or more stop features comprise a stop flange projecting outwardly beyond a front wall of the ladder engagement unit against which the bracing members abut in the working state.

7. The apparatus of claim 1 wherein displacement of each bracing member is enabled by relative sliding between the bracing member and the ladder engagement unit along a respective shaft, and a respective spring is coiled around each shaft to bias the respective bracing member and the ladder engagement unit toward one another along said shaft.

8. The apparatus of claim 7 wherein each bracing member comprises a frame having an open center, the ladder engagement unit comprises a hollow structure, each shaft passes through a front wall of said hollow structure and a mounting side of the respective bracing member that faces toward said front wall of said hollow structure, the shaft is slidable relative said front wall, and each spring is coiled around the respective shaft between said front wall of the hollow structure and a stop element that projects outwardly from said shaft on a side of said front wall opposite the respective bracing member.

9. The apparatus of claim 8 wherein each shaft is defined by a respective bolt, a head of which defines the respective stop element.

10. The apparatus of claim 1 comprising a locking mechanism by which the first and second bracing members are lockable in each of the first and second positions.

11. The apparatus of claim 1 wherein the attachment mechanism of the ladder engagement unit comprises first and second clamping members coupled together and movable relative to one another between a closed-together clamping condition and a more separated open condition, the first and second members being shaped to define a rung-accommodating space between them in the closed-together clamping condition, whereby the ladder engagement unit is attachable to a rung of the ladder by closing the first and second clamping members together around the rung.

12. The apparatus of claim 1 wherein the bracing members are positioned to leave an open slot extending toward the ladder engagement unit between said bracing members when both of said bracing members are in the second position, and a width of said open slot exceeds a standardized thickness of a piece dimensional lumber, whereby said piece of dimensional lumber is receivable within said open slot to stabilize the ladder relative to the said piece of dimensional lumber.

13. A ladder stabilization apparatus for stabilizing a ladder in an upright position against a structure to which the ladder is not affixed, the stabilization apparatus comprising:

a ladder engagement unit having an attachment mechanism for securing said ladder engagement to the ladder in a stationary position relative thereto;

first and second bracing members attached or attachable to the ladder engagement unit at a side thereof that faces outwardly from a plane of the ladder when secured thereto in the stationary position, each bracing member having a respective contact side for abutting against the structure during stabilization of the ladder; and a locking mechanism;

wherein:

the bracing members are securable to the ladder engagement unit in two distinct positions mated therewith, including in a first position in which the respective contact sides diverge away from one another in a direction moving outwardly away from the ladder engagement unit and a second position in which the respective contact sides converge toward one another in said direction moving outwardly away from the ladder engagement unit;

the first and second bracing members are lockable in each of the first and second positions by the locking mechanism; and the locking mechanism comprises a single locking device by which both the first and second bracing members are locked through a singular actuation of said locking device;

whereby placement of the first and second bracing members in the first position accommodates diverging walls of an outside corner of the structure between the diverging contact sides of the bracing members to stabilize the ladder against said diverging walls of the structure, and placement of the first and second bracing members in the second position accommodates an abutment of converging walls of an inside corner of the structure against the converging contact sides of the bracing members to stabilize the ladder against said converging walls.

14. The apparatus of claim 13 wherein each bracing member is movably coupled to the ladder engagement unit in a manner enabling movement of the bracing member between the first and second positions without full detachment from the ladder engagement unit.

15. The apparatus of claim 14 wherein each bracing member is displaceable toward and away from the ladder engagement unit for movement between a working state abutted against the ladder engagement unit in either one of the first and second positions and a withdrawn state drawn away from the ladder engagement unit, and is rotatable between reversed first and second orientations in the withdrawn state that will place the bracing member in a respective one of the first or second positions upon return of the bracing member toward the ladder engagement unit in a selected one of said first and second positions.

16. The apparatus of claim 13 wherein the single locking device is operable to lock each bracing member in both the first and second positions.

17. The apparatus of claim 13 wherein the ladder engagement unit comprises one or more stop features thereon for obstructing movement of the bracing members out of a selected one of the first and second positions in which the bracing members reside.

18. The apparatus of claim 17, wherein the one or more stop features comprise a stop flange projecting outwardly beyond a front wall of the ladder engagement unit against which the bracing members abut in the first second positions.

19. The apparatus of claim 13 wherein the attachment mechanism of the ladder engagement unit comprises first and second clamping members coupled together and movable relative to one another between a closed-together clamping condition and a more separated open condition, the first and second members being shaped to define a rung-accommodating space between them in the closed-together clamping condition, whereby the ladder engagement unit is attachable to a rung of the ladder by closing the first and second clamping members together around the rung.

20. The apparatus of claim 13 wherein the bracing members are positioned to leave an open slot extending toward the ladder engagement unit between said bracing members when both of said bracing members are in the second position, and a width of said open slot exceeds a standardized thickness of a piece dimensional lumber, whereby said piece of dimensional lumber is receivable within said open slot to stabilize the ladder relative to the said piece of dimensional lumber.

* * * * *